US010252900B2

(12) United States Patent
Cook

(10) Patent No.: US 10,252,900 B2
(45) Date of Patent: Apr. 9, 2019

(54) APPARATUSES, SYSTEMS, AND METHODS FOR DISPENSING BEVERAGES USING ALCOHOLIC CONCENTRATES

(71) Applicant: Cornelius Beverage Technologies Limited, West Yorkshire (GB)

(72) Inventor: Christopher Michael Cook, Worcestershire (GB)

(73) Assignee: Cornelius Beverage Technologies Limited, West Yorkshire (GB)

( * ) Notice: Subject to any disclaimer, the term of this patent is extended or adjusted under 35 U.S.C. 154(b) by 0 days.

(21) Appl. No.: 15/693,792

(22) Filed: Sep. 1, 2017

(65) Prior Publication Data

US 2018/0155176 A1 Jun. 7, 2018

Related U.S. Application Data

(60) Provisional application No. 62/431,232, filed on Dec. 7, 2016.

(51) Int. Cl.
*B67D 1/00* (2006.01)
*B67D 1/08* (2006.01)
(Continued)

(52) U.S. Cl.
CPC ..... *B67D 1/0016* (2013.01); *B67D 1/0031* (2013.01); *B67D 1/07* (2013.01);
(Continued)

(58) Field of Classification Search
CPC ..... B67D 1/0016; B67D 1/0031; B67D 1/07; B67D 1/0864; B67D 1/0888; B67D 1/10;
(Continued)

(56) References Cited

U.S. PATENT DOCUMENTS 3,386,261 A 9/1966 Cornelius
3,634,107 A * 1/1972 Cornelius ..... A47J 31/40 99/275

(Continued)

FOREIGN PATENT DOCUMENTS

| | | |
|---|---|---|
| EP | 0 152 283 | 8/1985 |
| WO | 1992/021607 | 12/1992 |
| WO | 2016083482 | 6/2016 |

OTHER PUBLICATIONS

International Search Report, PCT/IB2017/056920, dated Feb. 9, 2018.
Written Opinion, PCT/IB2017/056920, dated Feb. 9, 2018.

*Primary Examiner* — Frederick C Nicolas
(74) *Attorney, Agent, or Firm* — Andrus Intellectual Property Law, LLP

(57) ABSTRACT

A beverage dispenser includes a gas infusion device that receives a base fluid and a gas and dispenses a gas infused liquid, a ratio pump that receives the gas infused liquid and a concentrate from a concentrate source and dispenses a predetermined ratio of the gas infused liquid and the concentrate, and a mixing chamber that mixes the predetermined ratio of the gas infused liquid and the concentrate to form a reconstituted beverage. An insulated enclosure has an interior space in which the ratio pump and the mixing chamber are positioned. A cooling heat exchanger is positioned in the insulated enclosure, and a first refrigeration system circulates a cooling media through the cooling heat exchanger to thereby cool the interior space to a suitable temperature such that the gas infused liquid and the concentrate dispensed from the ratio pump and the mixing chamber are cooled to the suitable temperature.

33 Claims, 7 Drawing Sheets

(51) Int. Cl.
*B67D 1/10* (2006.01)
*B67D 1/07* (2006.01)
*B67D 1/12* (2006.01)

(52) U.S. Cl.
CPC ..... *B67D 1/0864* (2013.01); *B67D 1/0888* (2013.01); *B67D 1/10* (2013.01); *B67D 1/1252* (2013.01); *B67D 1/1288* (2013.01); *B67D 1/0066* (2013.01); *B67D 1/0857* (2013.01); *B67D 1/0865* (2013.01); *B67D 1/0867* (2013.01); *B67D 1/0884* (2013.01); *B67D 1/125* (2013.01); *B67D 2001/0093* (2013.01)

(58) Field of Classification Search
CPC .. B67D 1/1252; B67D 1/1288; B67D 1/0066; B67D 1/0857; B67D 1/0865; B67D 1/0867; B67D 1/0884; B67D 1/125; B67D 2001/0093
See application file for complete search history.

(56) References Cited

U.S. PATENT DOCUMENTS 3,851,797 A * 12/1974 Jacobs ..... B67D 1/0004 222/129.4
4,493,441 A * 1/1985 Sedam ..... B67D 1/0021 222/129.1
4,708,827 A * 11/1987 McMillin ..... B67D 1/0057 261/158
4,745,853 A * 5/1988 Hoover ..... A23L 2/54 261/27
4,967,936 A 11/1990 Bingler
5,021,250 A * 6/1991 Ferguson ..... B67D 1/00 222/1
5,085,810 A * 2/1992 Burrows ..... B01F 3/04531 261/140.1
5,411,179 A * 5/1995 Oyler ..... B67D 1/00 222/129.1
5,537,914 A * 7/1996 Gibney ..... B67D 1/0016 137/101.19
5,565,149 A * 10/1996 Page ..... B01D 19/0031 210/321.8
5,706,661 A * 1/1998 Frank ..... A23G 9/045 426/67
5,738,248 A 4/1998 Green
6,045,007 A * 4/2000 Simmons ..... B67D 1/0035 141/100
6,260,477 B1 * 7/2001 Tuyls ..... A23F 3/163 261/DIG. 7
6,505,758 B2 * 1/2003 Black ..... B67D 1/0034 222/146.6
6,644,508 B2 * 11/2003 Haskayne ..... B67D 1/0057 222/1
6,685,054 B2 * 2/2004 Kameyama ..... B67D 1/0037 222/129.3
6,712,342 B2 * 3/2004 Bosko ..... B01D 61/08 261/104
8,485,394 B2 * 7/2013 Tachibana ..... A23L 2/54 222/129.1
9,146,564 B2 * 9/2015 Winkler ..... G05D 7/0635
9,623,383 B1 * 4/2017 Kleinrichert ..... B01F 3/04808
9,630,826 B2 * 4/2017 Green ..... B67D 1/0058
2002/0113087 A1 8/2002 Ziesel
2005/0072800 A1 4/2005 Smith
2010/0163572 A1 * 7/2010 Downham ..... B67D 1/0004 222/1
2013/0251868 A1 9/2013 Wells

* cited by examiner

APPARATUSES, SYSTEMS, AND METHODS FOR DISPENSING BEVERAGES USING ALCOHOLIC CONCENTRATES

CROSS-REFERENCE TO RELATED APPLICATION

The present application is based on and claims priority to U.S. Provisional Patent Application Ser. No. 62/431,232 filed Dec. 7, 2016, the disclosure of which is incorporated herein by reference.

FIELD

The present application relates to apparatuses, systems, and methods for dispensing beverages, specifically beverage dispensers for reconstituting and dispensing alcoholic beverages formed from base fluids, gases, and alcoholic concentrates.

BACKGROUND

The following Patent Application is incorporated herein by reference, in entirety:

International Application Published under the Patent Cooperation Treaty (PCT) having International Publication No. WO 2016/083482.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A beverage dispenser includes a gas infusion device that receives a base fluid and a gas and dispenses a gas infused liquid comprising the base fluid and the gas. A ratio pump receives the gas infused liquid and a concentrate from a concentrate source and dispenses a predetermined ratio of the gas infused liquid and the concentrate. A mixing chamber mixes the predetermined ratio of the gas infused liquid and the concentrate to form a reconstituted beverage. A valve receives the reconstituted beverage and dispenses the reconstituted beverage to the operator. An insulated enclosure has an interior space in which the ratio pump and the mixing chamber are positioned. A cooling coil is positioned in the insulated enclosure, and a first refrigeration system circulates a cooling media through the cooling coil to thereby cool the interior space to a predetermined temperature such that the gas infused liquid and the concentrate dispensed from the ratio pump and the mixing chamber are cooled to the predetermined temperature.

A beverage dispenser includes a gas infusion device that receives a gas and a base liquid and dispenses a gas infused liquid comprising the gas and the base liquid. A ratio pump receives the gas infused liquid and a concentrate and dispenses a predetermined ratio of the concentrate and the gas infused liquid. The predetermined ratio of the concentrate and the gas infused liquid form a reconstituted beverage. A valve receives the reconstituted beverage and dispenses the reconstituted beverage to the operator. A boost pump increases the pressure of the gas infused liquid such that the gas is maintained in the gas infused liquid during operation of the beverage dispenser, and the boost pump maintains pressure of the gas infused liquid at or above an equilibrium pressure such that pressure of the reconstituted beverage upstream from the valve is equal to or greater than the equilibrium pressure when the valve is opened.

A method of reconstituting an alcoholic beverage includes receiving, with a gas infusion device, base fluid and a gas to be infused into the base fluid to thereby form a gas infused liquid; increasing, with a boost pump, pressure of the gas infused liquid; receiving, with a ratio pump, the gas infused liquid and a concentrate; dispensing, with the ratio pump, a predetermined ratio of the gas infused liquid and concentrate; mixing, with a mixing chamber, the predetermined ratio of the gas infused liquid and the concentrate to form a reconstituted beverage; and dispensing, with a valve, the reconstituted beverage to an operator.

Various other features, objects, and advantages will be made apparent from the following description taken together with the drawings.

BRIEF DESCRIPTION OF THE DRAWINGS

Examples of the present disclosure are described with reference to the following drawing figures. The same numbers are used throughout the drawing figures to reference like features and components.

DETAILED DESCRIPTION

In the present disclosure, certain terms have been used for brevity, clarity, and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives, and modifications are possible within the scope of the appended claims.

Reconstituting alcoholic beverages (e.g. beer, alcoholic ciders) from alcoholic concentrates and base liquid(s) (e.g. water) is becoming increasingly popular in many pubs and/or restaurants as a way of minimizing the space needed to store multiple beverages. That is, a relatively large number of alcoholic concentrates can be stored in a small space (in contrast to the large space needed to store large, conventional beverage kegs containing alcoholic beverages) and combined with a local water source to form a mixed or reconstituted beverage on-location and on-demand for the consumer. Furthermore, reconstituting alcoholic beverages on-site or at the retailer can minimize the cost of transporting heavy cans, bottles, and/or kegs of alcoholic beverages that contain a high percentage of water. However, many problems and/or obstacles (e.g. correctly matching the flavor, mixing the correct ratio of concentrate, maintaining gases infused in the water, matching the foam height of the beverage when dispensed) must be overcome or solved when reconstituting alcoholic beverages from alcoholic concentrates and base fluids.

Through research and experimentation, the present inventor has endeavored to develop apparatuses, systems, and methods that effectively dispense alcoholic beverages reconstituted or formed from a base liquid (e.g. water) and a concentrate (e.g. an alcoholic beverage concentrate). The present inventor has discovered beverage dispensers that quickly and effectively combine the alcoholic concentrate with a base fluid to dispense an alcoholic beverage (e.g. beer).

Figure 1:
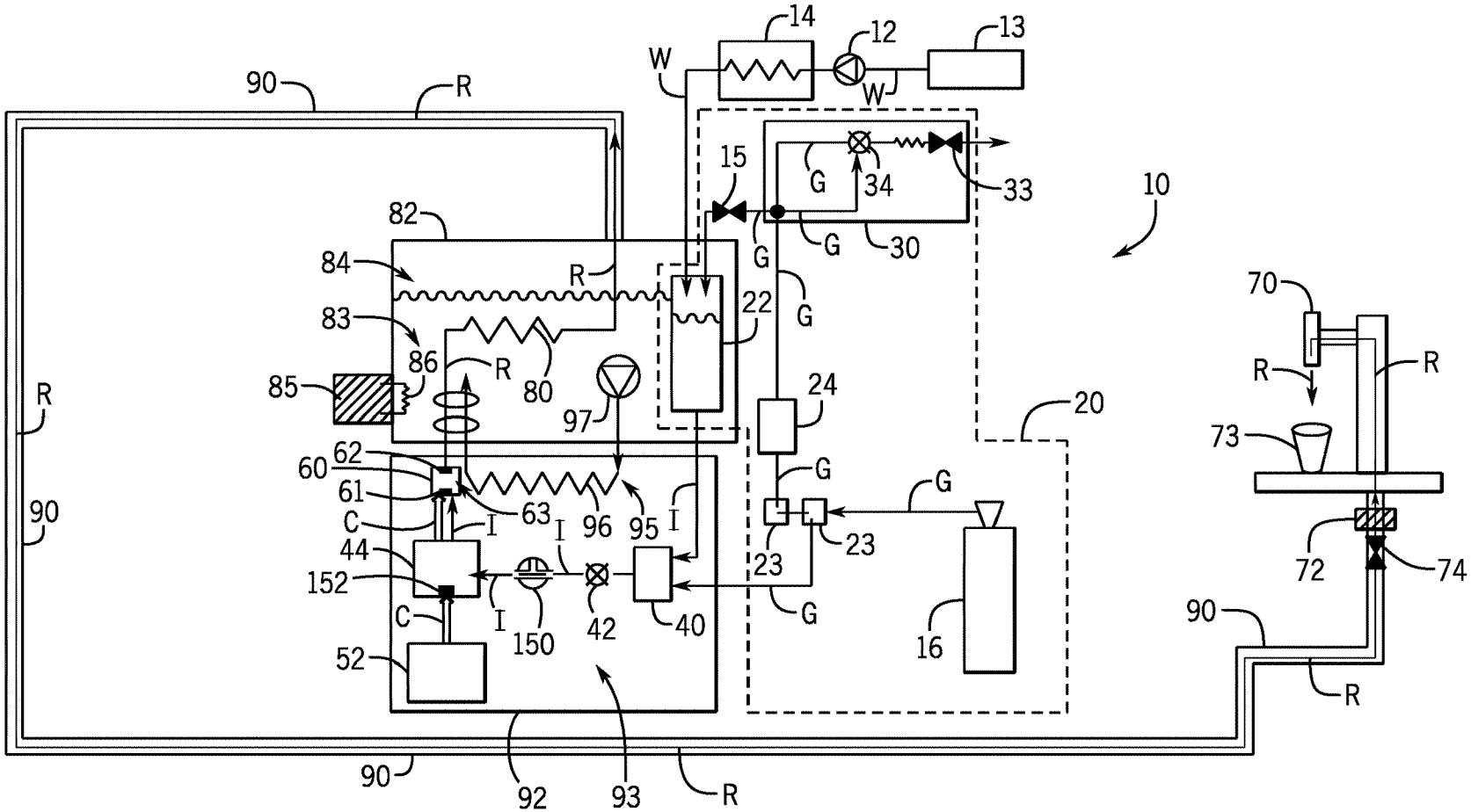
FIG. 1 is a schematic diagram of an example beverage dispenser.

FIG. 1 depicts an example schematic diagram for a beverage dispenser 10 according to the present disclosure. The beverage dispenser 10 includes a base liquid inlet 12 that is configured to receive a base liquid (e.g. drinking water, filtered drinking water, carbonated water, water-syrup solution) (note that pipes or conduits through which the base liquid is conveyed are labeled W) from a base liquid source 13 (e.g. water tank, pressurized water tank, municipal water source). The base liquid can be modified to suit the requirements of a finished or reconstituted beverage (described herein) (e.g. the base liquid may be filtered, purified, fortified) such that the composition of the base fluid closely matches the base fluid used by the original manufacturer (e.g. brewery) to make or form the original, non-concentrate finished beverage (e.g. beer). That is, the base fluid is modified by various devices (e.g. water filtration device, reverse osmosis (RO) water processing station, blending device) to "normalize" the geographically different base fluids and thereby decrease the variability and increase the quality of the reconstituted beverage that is formed and dispensed from the beverage dispenser 10.

The base fluid is cooled by a base fluid cooling or refrigeration system 14 to a suitable or predetermined temperature before being conveyed to a gas infusion device 22 (described herein). The base fluid refrigeration system 14 can be any suitable type of refrigeration system that is commonly used in the industry (e.g. the base fluid refrigeration system can be an air-cooled system, a water-cooled system, an ice-bank based cooling system, or a combination system thereof).

The beverage dispenser 10 also includes a gas inlet 15 that receives a pressurized gas (e.g. $CO_2$, $N_2$, $O_2$, mixed gas) (note that pipes or conduits through which the gas is conveyed are labeled G) from a gas source 16 (e.g. gas tank, compressor). The gas is infused into the base fluid by use of the gas infusion device 22. The gas can be modified to suit the requirements of a finished or reconstituted beverage (described herein) (e.g. the gas may be filtered) such that the composition of the gas closely matches (i.e. the gas is reconstructed) the gas of the original, non-concentrate finished beverage. That is, the gas can be modified by various devices (e.g. gas filtration device, gas lending device) to "normalize" the geographically different gas sources and thereby decrease the variability and increase the quality of the reconstituted beverage that is formed and dispensed from the beverage dispenser 10. For example, a gas filtration device 24 can be included to filter the gas to closely match the gas in the original, non-concentrate finished beverage. The type of gas filtration device 24 can vary and may include a taste filter and/or odors filter. An example gas filtration device 24 is commercially available from Parker Dominic Hunter (model number MD-2).

The gas inlet 15 can be part of a gas infusion system 20 (e.g. carbonation system) having the gas infusion device 22 (e.g. carbonator, gas sparger) that receives the base fluid and the gas, infuses the gas into the base fluid, and dispenses a gas infused liquid (note that pipes or conduits through which gas infused liquid is conveyed are labeled I).

Gas regulator(s) 23 are included and configured to allow an operator to regulate the flow of the gas through the gas infusion system 20 and/or isolate the gas source 16 from the rest of the beverage dispenser 10.

Figure 2:
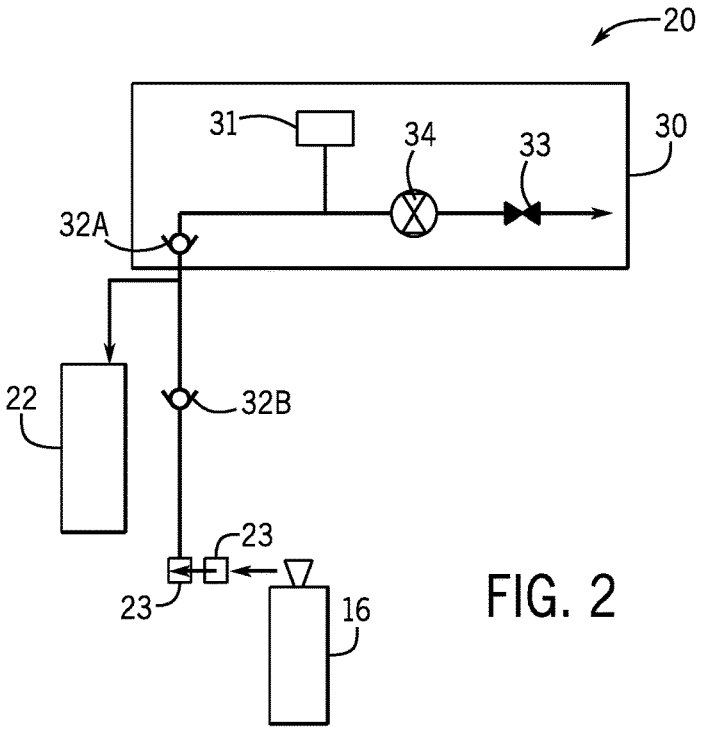
FIG. 2 is an example gas infusion system with an auto-vent device.

The gas infusion system 20 can also include an auto-vent device 30 configured to vent excess gas from the gas infusion device 22 and/or the gas infusion system 20 and/or lower the pressure of the gas when the pressure in the gas infusion device 22 and/or gas infusion system 20 exceeds a predetermined maximum pressure limit or value. Referring specifically to FIG. 2, an enlarged view of an example gas infusion system 20 having an example auto-vent device 30 is depicted. The auto-vent device 30 includes a gas pressure sensor 31 that senses the pressure of the gas in the gas infusion system 20 and at least one check valve 32A, 32B (e.g. a first check valve 32A prevents gas from flowing from the auto-vent device 30 to the gas infusion device 22 and a second check valve 32B prevents gas from flowing from the gas infusion device 22 and/or auto-vent device 30 to the gas regulator(s) 23). An electric valve 34 is included and configured to open when the pressure detected by the gas pressure sensor 31 exceeds the predetermined maximum pressure limit such that gas is "vented" from the gas infusion system 20 via an outlet flow control throttle 33. The auto-vent device 30 can be configured to maintain the gas infusion device 22 at less than 5 PSI above a maximum gas infusion device pressure, which may correspond to the maximum allowed pressure of the gas infusion device 22. The gas pressure sensor 31 can be a mechanical pressure switch and/or electronic pressure gauge, and the gas pressure sensor 31 and/or the electric valve 34 can be in communication with and/or controlled by a controller 116 (described further herein). Any suitable gas pressure sensor or outlet flow control valve can be utilized (e.g. an example gas pressure sensor is commercially available from Syncro P.E. srl, part no. Pressostat PE-1, and an example outlet flow control valve is commercially available from Hydralectric, 7303-HQ-10-2-R).

Referring back to FIG. 1, the present inventor has recognized that is it desirable to effectively and efficiently dispense a reconstituted beverage (note that pipes or conduits through which the reconstituted beverage is conveyed are labeled R), formed from the gas infused liquid and a concentrate (described herein), that has the same beverage characteristics (e.g. odor, taste, foam, visual appearance) as an original, non-concentrate beverage. The present inventor has also recognized that in order to dispense the reconstituted beverage with accurate beverage characteristics, the liquid pressures of the gas infused liquid and the reconstituted beverage in the beverage dispenser 10 (i.e. upstream of a dispensing valve 72 (described herein)) must be maintained above an equilibrium pressure such that the pressures of the gas infused liquid and the reconstituted beverage do not fall below the equilibrium pressure when the dispensing valve 72 is opened to dispense the reconstituted beverage to the operator. Furthermore, the inventor has recognized that as the reconstituted beverage is formed and conveyed through the beverage dispenser 10, the various components and devices of the beverage dispenser 10 described herein may cause the pressure of the reconstituted beverage to decrease.

Accordingly, the present inventor has endeavored to solve these problems and have discovered the beverage dispenser 10 of the present disclosure. During operation of the beverage dispenser 10, the gas infused liquid dispensed from the gas infusion device 22 is pressurized to an equilibrium pressure such that the gas does not readily breakout from the base fluid (i.e. the gas infused liquid is in a state of "equilibrium"). In order to maintain the gas in the base fluid, the pressure of the gas infused liquid is maintained above the equilibrium pressure throughout the beverage dispenser 10 by a boost pump 40. The boost pump 40 is positioned downstream of the gas infusion device 22 and is configured to increase the pressure of the gas infused liquid such that the gas infused in the gas infused liquid remains in solution (i.e. the gas infused in the base fluid does not "breakout" of the infused liquid and is maintained at the equilibrium pressure).

For example, the boost pump 40 is configured to maintain the liquid pressure of the gas infused liquid at or above the equilibrium pressure such that the pressure of the reconstituted beverage upstream from the valve 72 is equal to or greater than the equilibrium pressure when the valve 72 is opened. When the valve 72 is closed, the boost pump 40 increases the pressure of the gas infused liquid to a hyper-equilibrium pressure that is greater than the equilibrium pressure. By increasing the pressure of the gas infused liquid when the valve is closed to the a hyper-equilibrium pressure, the pressures of the gas infused liquid and/or reconstituted beverage in the beverage dispenser 10 do not decrease or drop below the equilibrium pressure when the valve 72 is subsequently opened. That is, the boost pump 40 is configured to increase the pressure of the gas infused liquid above the equilibrium pressure when the valve 72 it closed to thereby account for the pressure decrease or drop experienced by the gas infused liquid and the reconstituted beverage in the beverage dispenser 10 when the valve 72 is opened. Accordingly, the liquid pressure of the gas infused liquid and/or the reconstituted beverage in the beverage dispenser 10 are maintained at or above the equilibrium pressure at all times within the beverage dispenser. Furthermore, if the pressure of the gas infused liquid is not maintained at or above (i.e. equal to or greater than) the equilibrium pressure, there is a likelihood that an inaccurate amount of the gas infused liquid and the concentrate will be mixed by the beverage dispenser 10.

The present inventor has also recognized that pressurizing the gas infused liquid to the hyper-equilibrium pressure when the valve 72 is closed prevents the gas from prematurely breaking out of solution and thereby maintains the quality of the reconstituted beverage and/or dispense quality of the reconstituted beverage from a tap 70 (note that in certain examples the dispensing valve 72 is integral with the tap 70). In addition, utilization of the boost pump 40 in the beverage dispenser 10 allows low-volume, low-pressure gas infusion devices 22 to be used and permits adjustments to the dispense speed of the reconstituted beverage from the valve 72 and/or the tap 70 to the operator. The boost pump 40 can also be configured to account for pressure changes during normal operation such as changes in temperature experienced by the gas infused liquid, the concentrate, and/or the reconstituted beverage that would otherwise cause the gas to breakout of the gas infused liquid and/or the reconstituted beverage.

In one non-limiting example, the gas infused liquid downstream of the gas infusion device 22 and upstream of the boost pump 40 is pressurized to an equilibrium pressure of 31 pounds per square inch (PSI). The boost pump 40, which can be supplied with pressurized gas from the gas source 16, adds 31 PSI to the gas infused liquid such that hyper-equilibrium pressure of the gas infused liquid when the valve 72 is closed in 62 PSI. When the valve 72 is opened, reconstituted beverage is dispensed to the operator and the liquid pressure is the near or equal to the equilibrium pressure (i.e. the pressures do not fall or drop below the equilibrium pressure). The acceptable maximum equilibrium and hyper-equilibrium pressures will be limited by the pressure rating of the components of the beverage dispenser, and the acceptable minimum equilibrium and hyper-equilibrium pressures will depend of the flow rate of the reconstituted beverage from the dispensing valve 72. The equilibrium pressure and the hyper-equilibrium pressure can vary. In one non-limiting example the equilibrium pressure is in the range of 25.0 PSI to 32.0 PSI and the hyper-equilibrium pressure is in the range of 55.0 PSI to 65.0 PSI. In one non-limiting example, the equilibrium pressure is preferably 31.0 PSI and the hyper-equilibrium pressure is preferably 62.0 PSI. A person having ordinary skill in the art will recognize that the operational pressures (e.g. the equilibrium pressure and the hyper-equilibrium pressure) may vary based on installation conditions of the beverage dispenser 10 and/or the manufacturer or retailer requirements for the reconstituted beverage.

The beverage dispenser 10 includes a latching valve 42 positioned downstream of the boost pump 40 and configured to regulate flow of the gas infused liquid from the boost pump 40. The beverage dispenser 10 also includes a ratio pump 44 that is configured to accurately, efficiently, and effectively dispense a predetermined ratio of the gas infused liquid and the concentrate to thereby form the reconstituted beverage. The ratio pump 44 receives the gas infused liquid from the boost pump 40 (i.e. the ratio pump 44 is downstream from the boost pump 40) and the concentrate or concentrate liquid (e.g. alcoholic beverage concentrate, beer concentrate) (note that pipes or conduits through which the concentrate is conveyed are labeled C) from a concentrate source 52 (e.g. pressurized tank, bag-in-box container). The ratio pump 44 is further configured to accurately and consistently dispense the concentrate and the gas infused liquid downstream under a variety of conditions (e.g. pressures, temperatures, types of base waters, types of concentrates) to thereby produce the reconstituted beverage. Any suitable ratio pump can be utilized (e.g. an example ratio pump is commercially available from Pentair, model no. 94 260 05). The present inventor has discovered that the accuracy of the predetermined ratio of the concentrate and the gas infused water being conveyed from the ratio pump 44 is increased when the pressure of the gas infused liquid is equal to or greater than the equilibrium pressure. The ratio pump 44 can be powered by any suitable source, and in certain examples, the ratio pump 44 is driven by the pressurized gas infused liquid received by the ratio pump 44.

Figure 4:
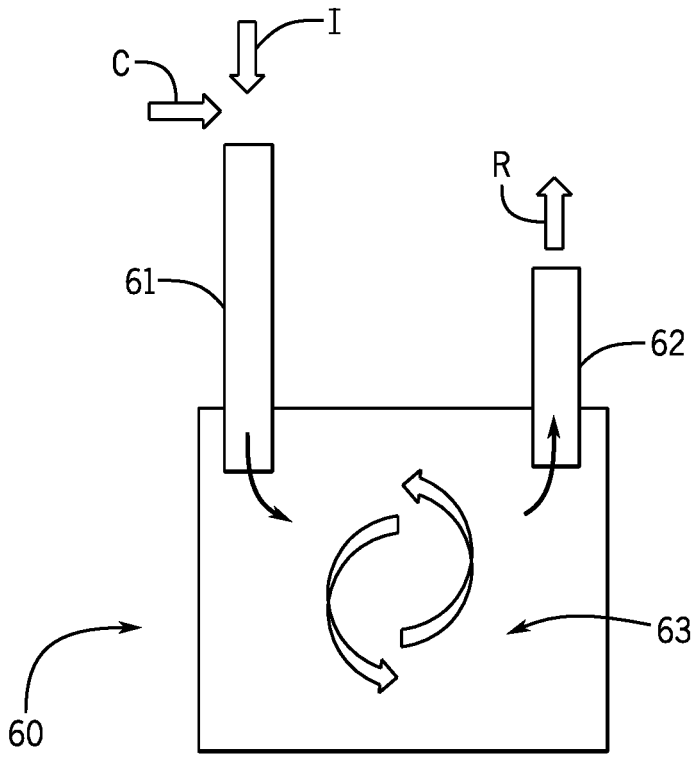
FIG. 4 is a cross sectional view of an example mixing chamber.

As the concentrate and the gas infused liquid dispensed by the ratio pump 44 are conveyed downstream toward the dispensing valve 72 and the tap 70, the concentrate and the gas infused liquid mix to form the reconstituted beverage. That is, of the concentrate and the gas infused liquid need not be fully mixed (i.e. a fully homogeneous reconstituted beverage) as the liquid are dispensed from the ratio pump 44 (i.e. the liquids will be mixed as the liquids are conveyed downstream). Optionally, a mixing plenum or chamber 60 (see also FIG. 4) is positioned downstream of the ratio pump 44 and is configure to receive the concentrate and the gas infused liquid via an inlet 61 and dispense the mixed, reconstituted beverage via an outlet 62. The mixing chamber 60 has an interior space 63 in which the gas infused liquid and the concentrate mix to form the reconstituted beverage. The interior space 63 is positioned vertically below the inlet 61 and/or the outlet 62 such that the flow of the liquids change direction as the liquids are conveyed through the mixing chamber 60 thereby completely mixing the concentrate and the gas infused liquid to form the reconstituted beverage. The size and shape the mixing chamber 60 can vary. In one non-limiting example, the volume of liquid that can be held by the mixing chamber is 120 cubic centimeters or 4.0 ounces.

The reconstituted beverage is cooled downstream of the ratio pump 44 and/or the mixing chamber 60 as the reconstituted beverage is conveyed through a beverage cooling coil 80 positioned in a cooling tank 82. The cooling tank 82 defines a cavity 84 and is configured to receive and contain a cooling media 83. A cooling or refrigeration system 85, which may be remote to the cooling tank 82, is configured to cool the cooling media 83. The refrigeration system 85 can be any suitable type of refrigeration system that is commonly used in the industry (e.g. the refrigeration system 85 can be an "ice bank" system, air-cooled system, a water-cooled system, or a combination system thereof).

In certain examples, the refrigeration system 85 includes a cooling coil 86 that is positioned in the cooling tank 82 and in contact with the cooling media 83. The refrigeration system 85 also includes a heat exchanger (not shown), a fan (not shown), and a pump (not shown) that is configured to circulate a coolant through the cooling coil 86 and the heat exchanger such that heat is transferred from the cooling media 83 via the cooling coil 86 to the coolant and the heat exchanger. In other examples, the refrigeration system 85 is (or includes) an ice-bank cooling system. The cooling tank 82 is made of any suitable material (e.g. plastic, metal) and is insulated. In certain examples, an agitator (not shown) is received in the cooling tank 82 to agitate and/or circulate the cooling media.

In the example depicted, the gas infusion device 22 is positioned in the cavity 84 such that the cooling media 83 contacts and cools the gas infusion device 22 and the fluids (e.g. the gas, the base fluid) therein. Optionally, other components or devices of the beverage dispenser 10 described herein can be positioned in the cavity 84 and/or cooled by the refrigeration system 85.

In certain examples, the beverage dispenser 10 includes a cooled beverage line 90 (e.g. a python cooling coil) configured to cool the reconstituted beverage as the reconstituted beverage is conveyed downstream to the dispensing valve 72 and the tap 70. In operation, when the operator selectively opens (manually or electrically) the dispensing valve 72 the reconstituted beverage is dispensed through the tap 70 to the operator, a consumer, and/or a receptacle (e.g. a beer pint glass 73). As the reconstituted beverage is dispensed through the dispensing valve 72 and/or the tap 70, the pressure of the reconstituted beverage decreases from the equilibrium pressure such that the beverage dispenses with a low foam height. The low foam height is achieved by slowly reducing the liquid pressure of the reconstituted beverage as it is conveyed through and/or from the tap 70 to thereby control the breakout of the gas (i.e. breakout the gas slowly) from the reconstituted beverage. In certain examples, a restrictor or restrictor tube 74 is positioned upstream of the tap 70 and/or the dispensing valve 72 and is configured to assist in pressure change of the reconstituted beverage as the reconstituted beverage is dispensed through the tap 70 and/or the dispensing valve 72. The restrictor tube 74 can also be configured to assist in breaking the gas out of the reconstituted beverage, prevent the reconstituted beverage from flowing backward upstream, and/or maintain the equilibrium pressure upstream in the beverage dispenser 10.

In certain examples, a shelf cooler (not shown) is positioned upstream of the restrictor tube 74. The shelf cooler is configured to hold a volume of the reconstituted beverage and cool the volume of the reconstituted beverage stored therein (e.g. the shelf cooler stores the reconstituted beverage relatively near the tap 70 such that the operator can quickly dispense the reconstituted beverage with minimum lag time). The shelf cooler can be coupled to the refrigeration systems described herein or coupled to an independent refrigeration system (not shown).

The present inventor has also discovered that it is important to maintain the temperatures of the gas, the base fluid, the gas infused liquid, the concentrate, and/or the reconstituted beverage in the beverage dispenser at a predetermined temperature so that reconstituted beverage dispenses effectively and efficiently to the operator. That is, the present inventor has discovered that cooling or maintaining the temperatures of the gas, the base fluid, the gas infused liquid, the concentrate, and/or the reconstituted beverage to a predetermined temperature(s) is important when forming and dispensing reconstituted beverage. The present inventor has also recognized that the reducing the temperature of the gas and/or base fluid prior to infusing, which may include dissolving, the gas into the base fluid to form the gas infused liquid is more effective and efficient than infusing the gas into the base fluid at ambient or elevated temperature(s). In addition, infusing the gas into the base fluid at relatively low pressures (e.g. 25 PSI) is more effective and efficient than infusing the gas into the base fluid at relatively high pressures. Furthermore, infusing the gas into the base fluid at low temperatures and low pressures prevents the gas from breaking out of the gas infused liquid.

Accordingly, the beverage dispenser 10 can include an insulated enclosure 92 that defines an interior space 93 that is cooled by a cooling or refrigeration system 95. The boost pump 40, the ratio pump 44, and/or the mixing chamber 60 are positioned in the interior space 93 such that the boost pump 40, the ratio pump 44, and/or the mixing chamber 60 are cooled to a predetermined temperature. In certain examples, the concentrate source 52 is positioned in the interior space 93 and cooled to the predetermined temperature. The cooling system 95 can be any suitable type of refrigeration system that is commonly used in the industry (e.g. an air-cooled system, a water-cooled system, or a combination system thereof). The predetermined temperature can be any suitable temperature. In certain non-limiting examples, the temperature of the cooling media circulated through the coiling coil is near freezing (e.g. 0.0-1.0 degrees Celsius) such that the temperature of the air in the interior space 63 is 5.0-8.0 degrees Celsius, preferably 6.0 degrees Celsius.

In the example depicted in FIG. 1, the cooling system 95 includes a cooling tube or coil 96 (e.g. a cooling media coil) positioned in the insulated enclosure 92 and a pump 97 configured to circulate the cooling media 83 from the adjacent refrigeration system 85 there through. Accordingly, heat is transferred from the interior space 93 via the cooling coil 96 to the cooling media 83 and the adjacent refrigeration system 85 thereby cooling the components positioned in the interior space 93 to the predetermined temperature.

Figure 3:
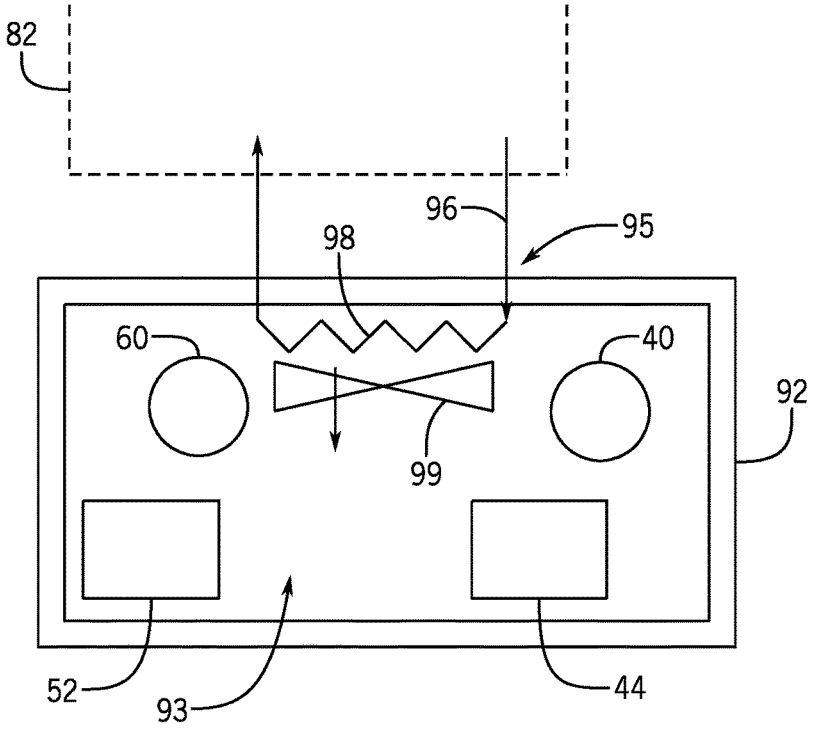
FIG. 3 is a cross sectional view of an example insulated enclosure.

In another example, as depicted by FIG. 3, the cooling system 95 includes a heat exchanger 98 and a fan 99 positioned in the interior space. The fan 99 is configured to move the air in the interior space 93 across the heat exchanger 98, and the heat exchanger 98 is coupled to the cooling coil 96 such that heat is transferred from the interior space 93 to the heat exchanger 98 and the cooling coil 96. In certain examples, the mixing chamber 60 is coupled to a cooling coil (not shown) that cools mixing chamber 60 and the liquids therein. In another example, the refrigeration system 85 includes a trace cooling system 94 that couples the beverage cooling coil 80 to the cooling coil 96. In another example, the cooling media 83 include freeze suppressants (e.g. glycol) to prevent system components from freezing.

Figure 5:
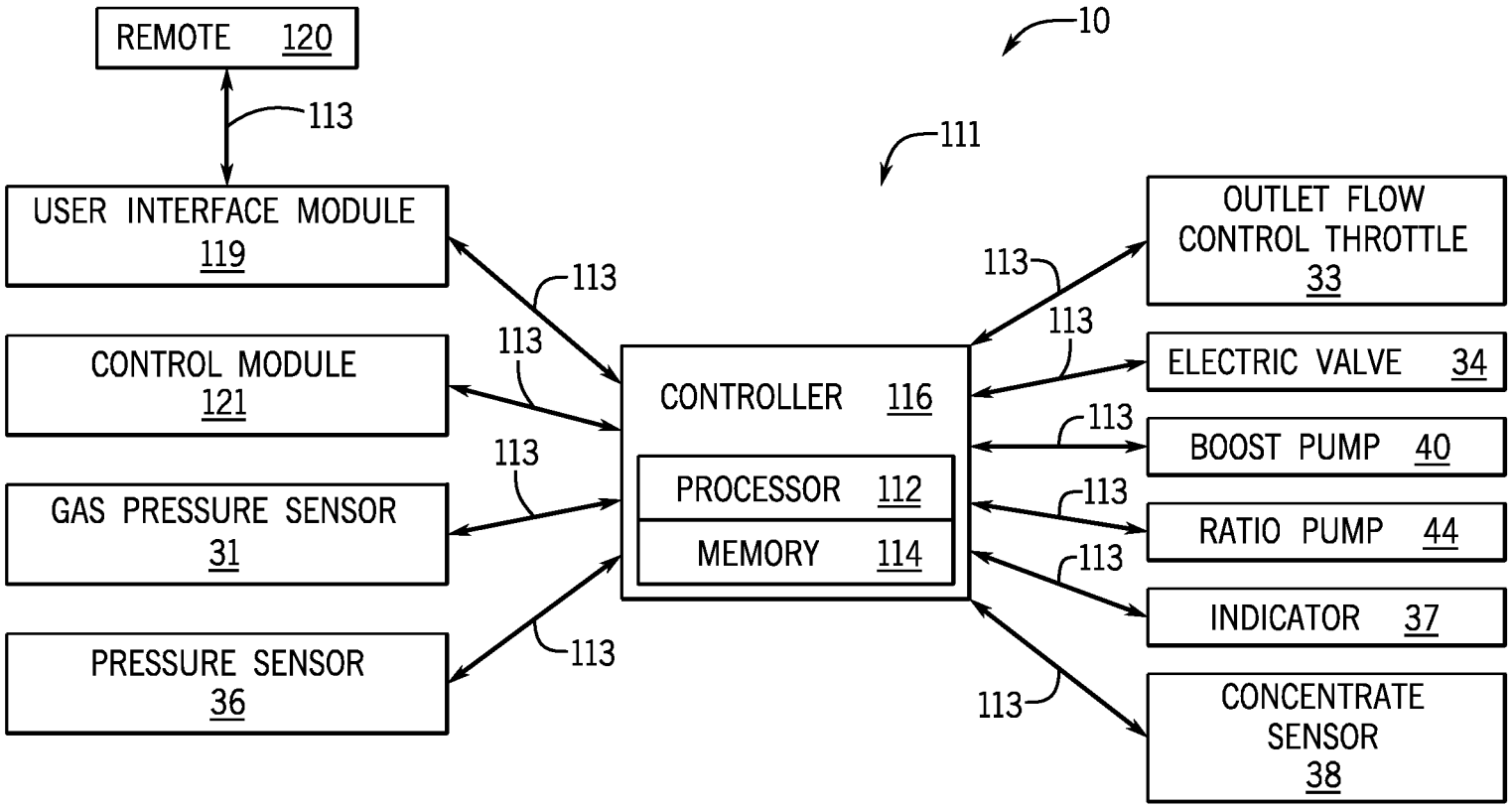
FIG. 5 is an example system diagram of the beverage dispenser.

FIG. 5 depicts an example computing system 111 of the beverage dispenser 10. In the example shown, the system 111 includes a controller 116, which is programmable and includes a processor 112 and a memory 114. The controller 116 can be located anywhere in the system 111 and/or located remote from the system 111. The controller 116 can communicate with various components of the dispenser via wired and/or wireless links, as will be explained further herein below. Although FIG. 5 shows a single controller 116, the system 111 can include more than one controller 116. Portions of the method can be carried out by a single controller or by several separate controllers. Each controller 116 can have one or more control sections or control units. One having ordinary skill in the art will recognize that the controller 116 can have many different forms and is not limited to the example that is shown and described. For example, the controller 116 carries out the dispensing control methods for the entire system 111, but in other examples dispensing control units could be provided.

In some examples, the controller 116 may include a computing system that includes a processing system, storage system, software, and input/output (I/O) interfaces for communicating with devices such as those shown in FIG. 5, and about to be described herein. The processing system loads and executes software from the storage system, such as software programmed with a dispensing control method. When executed by the computing system, dispensing control software directs the processing system to operate as described herein below in further detail to execute the dispensing control method. The computing system may include one or many application modules and one or more processors, which may be communicatively connected. The processing system can comprise a microprocessor (e.g., processor 112) and other circuitry that retrieves and executes software from the storage system. Processing system can be implemented within a single processing device but can also be distributed across multiple processing devices or subsystems that cooperate in existing program instructions. Non-limiting examples of the processing system include general purpose central processing units, applications specific processors, and logic devices.

The storage system (e.g., memory 114) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In one non-limiting example, the controller 116 communicates with one or more components of the system 111 via a communication link 113, which can be a wired or wireless link. The controller 116 is capable of monitoring and controlling one or more operational characteristics of the system 111 and its various subsystems by sending and receiving control signals via the communication link 113. It should be noted that the extent of connections of the communication link 113 shown herein is for schematic purposes only, and in non-limiting examples the communication link 113 can in fact provide communication between the controller 116 and each of the sensors, devices, and various subsystems described herein, although not every connection is shown in the drawing for purposes of clarity.

The system 111 may include several modules. For example, the user interface module 119 may be connected to a remote 120, a control panel, a connection port, and/or the like. In another non-limiting example, a control module 121 such as an internet or network module may connect the dispenser to the internet. The control module 121 may be wireless or wired, and the control module 121 may allow a remote user to control the components of the dispenser. The controller 116 may further relay data to and/or receive data from the beverage dispenser 10 such as switches, valves, pumps, displays, and/or the like.

In certain examples, the gas infusion device 22, boost pump 40 and the ratio pump 44 are electrically coupled to the controller 116. The operator of the beverage dispenser 10 can input into the user interface module 119 the selected gas infusion level (i.e. the amount of gas infused into the base liquid), the equilibrium pressure and hyper-equilibrium pressure, and/or the concentration of the concentrate relative to the gas infused liquid. Based on the inputs received via the user interface module 119, the controller 116 controls the various components of the beverage dispenser (e.g. the boost pump 40, the ratio pump 44). A person having ordinary skill in the art will recognize that other components, devices, and/or systems can be coupled to and controlled by the controller 116.

In certain examples, the gas pressure sensor 31, the outlet flow control throttle 33, and the electric valve 34 of the auto-vent device 30 are electrically coupled to the controller 116 by communication links 113 and controlled by the controller 116. In operation, the gas pressure sensor 31 senses pressure in the gas infusion system 20 and sends a signal to the controller 116 related to the sensed pressure. The controller 116 processes the signal from the gas pressure sensor 31 and controls the electric valve 34 and the outlet flow control throttle 33 (e.g. open and/or close the electric valve 34 and/or the outlet flow control throttle 33) to vent the gas pressure from the gas infusion system 20 when the pressure exceeds a predetermined or preprogrammed pressure.

Other pressure sensors 36 (e.g. gas pressure sensors, base fluid pressure sensors, gas infused liquid sensors, reconstituted beverage pressure sensors) can be positioned in the beverage dispenser 10 to sense the pressure of the various fluids. For example, a first pressure sensor 36 is configured to sense the pressure of the gas and a second pressure sensor 36 is configured to sense the pressure of the base fluid. The sensors 36 are coupled to the controller 116 via communication links 113 and configured to relay signals to the controller 116 related to the sensed pressures. The controller 116 is configured to determine if the pressures sensed by the sensors 36 are below low pressure limits and can then control, i.e. close, valves (e.g. the latching valve 42) to thereby stop flow of the base fluid, the gas, and/or the gas infused liquid. The controller 116 can also indicate to the operator via an indicator 37 (e.g. touchscreen panel, light, LED) that at least one of the gas and the base fluid pressures are below the low pressure limits and/or that the flow of gas and/or the base fluid has been stopped. Based on the state of the indicator 37, the operator is alerted to the beverage dispenser 10 such that the operator can inspect, repair the system, and/or replace the base liquid source 13 and/or the gas source 16. In certain examples, the status of the sensors 36, the base liquid source 13, and/or the gas source 16 are communicated to the operator via to the indicator 37 which is located at the point-of-dispense or tap 70.

The beverage dispenser 10 can include a concentrate sensor 38 configured to sense the presence (or absence) and/or pressure of the concentrate received by the beverage dispenser 10 from the concentrate source 53. The concentrate sensor 38 is coupled to the controller 116 via communication links 113 and configured to relay signals to the controller 116 related to the sensed state or pressure. The controller 116 is configured to determine if the concentrate is out-of-stock or if the concentrate is not pressurized to a prescribed pressure. Based on the signal from the concentrate sensor 38, the controller 116 can control, i.e. close, a concentrate valve (not shown) to thereby stop flow of the concentrate. The controller 116 can also be configured to stop operation of the ratio pump 44 when the concentrate is out-of-stock or the pressure of the concentrate is too low. The controller 116 can also indicate to the operator via the indicator 37 that at the concentrate is out-of-stock.

In certain examples, a method of reconstituting an alcoholic beverage includes receiving a base fluid and a gas to be infused into the base fluid in a gas infusion device 22; infusing the gas in the base fluid to form a carbonated water; increasing the pressure of the carbonated water; receiving the carbonated water and a concentrate in a ratio pump 44; conveying a selected ratio of the carbonated water and the concentrate form the ratio pump 44; mixing the carbonated water and the concentrate in a mixing chamber 60; and dispensing the alcoholic beverage from a tap 70.

Figure 6:
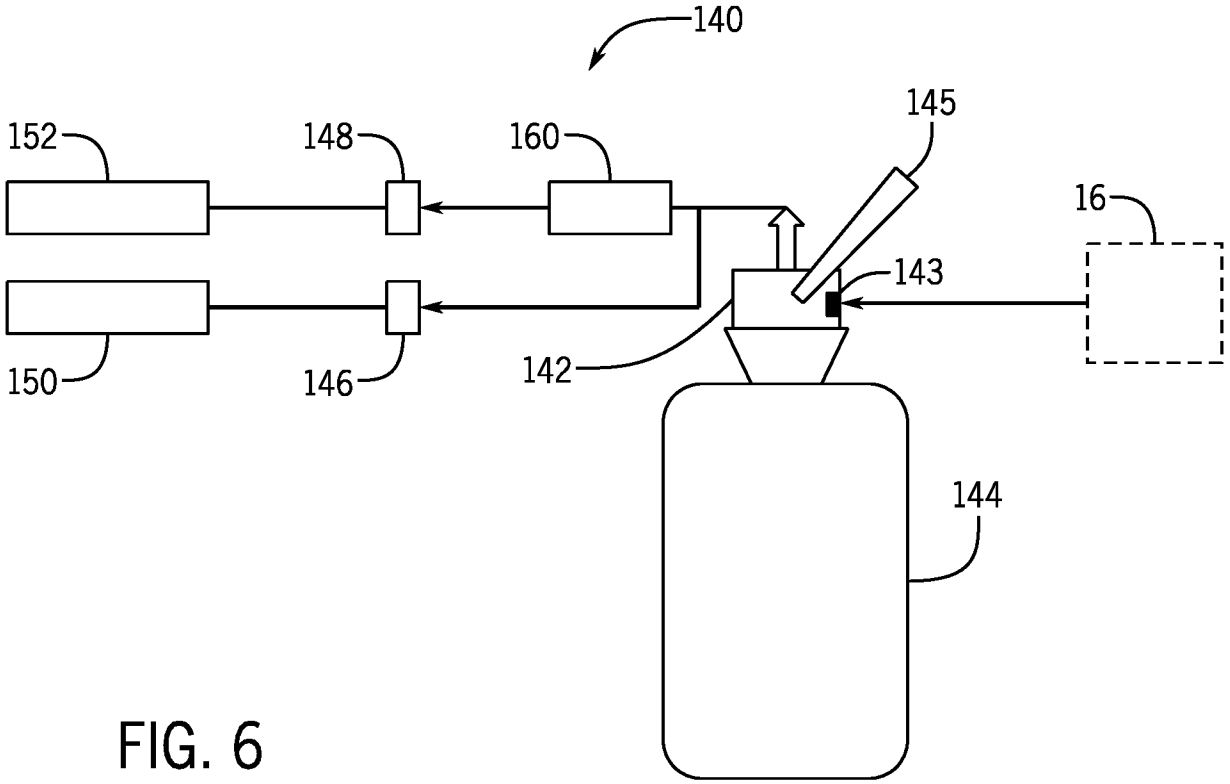
FIG. 6 is an example schematic diagram of an example cleaning assembly

Referring to FIG. 6, periodic and/or regular cleaning of the beverage dispenser 10 must be performed by the operator to ensure that the beverage dispenser 10 is operating as designed. A line cleaning apparatus or assembly 140 can be integral with or removably coupled to the beverage dispenser 10, and the cleaning assembly 140 is configured to dispense and/or convey a cleaning solution into the beverage dispenser 10 to clean and flush the conduits (i.e. lines, pipes) and the components (e.g. ratio pump) of the beverage dispenser 10 through which the concentrate, and/or the reconstituted beverage are conveyed.

The cleaning assembly 140 includes an inlet coupler 142 configured to couple to a cleaning liquid source 144 (e.g. pressurized dilute cleaning liquid source, pressurized tank, cleaning liquid reserve). The inlet coupler 142 can include a lever 145 that allows the operator to selectively lock or unlock the inlet coupler 142 to the cleaning liquid source 144. The inlet coupler 142 can also receive a pressurized gas or liquid via a port 143 such that the cleaning fluid is pressurized. The pressurized gas or liquid can be supplied to the inlet coupler 142 from the gas source 16 or another gas or liquid source independent from the beverage dispenser 10.

The cleaning assembly 140 includes a first outlet coupler 146 that is in fluid communication with the inlet coupler 142. The first outlet coupler 146 can be coupled to the beverage dispenser 10 such that the cleaning liquid is dispensed to a first inlet or cleaning switch 150 (see FIG. 1) to thereby clean the beverage dispenser 10 downstream of the cleaning switch 150. Similarly, the cleaning assembly 140 includes a second outlet coupler 148 that is in fluid communication with the inlet coupler 142. The second outlet coupler 148 can be coupled to the beverage dispenser 10 such that the cleaning liquid is dispensed to a second inlet or cleaning switch 152 (see FIG. 1) to thereby clean the beverage dispenser 10 downstream of the second inlet 152. That is, the cleaning liquid received via the first cleaning switch 150 and/or the second inlet 152 is conveyed downstream through the beverage dispenser 10 to thereby clean the conduits or pipes and/or components of the beverage dispenser 10.

In example beverage dispenser 10 depicted in FIG. 1, the second inlet 152 is the inlet through which the ratio pump 44 receives the concentrate from the concentrate source 52. In operation, the operator couples the first outlet coupler 146 to the cleaning switch 150, removes the conduit or pipe between the concentrate source 52 and the ratio pump 44, and couples the second outlet coupler 148 to the second inlet 152. The cleaning switch 150 is selectively switched from a first position in which the gas infused fluid can be conveyed through the beverage dispenser 10 and a second position in which the gas infused fluid is blocked from being conveyed through the beverage dispenser 10 and the cleaning solution is not conveyed upstream. The cleaning fluid can be continuously recirculated through the cleaning assembly 140 and/or the beverage dispenser 10 or the cleaning fluid can dispense from the tap 70 into a bucket or drain. In certain examples, cleaning assembly 140 has a regulator 160 that is configured to reduce the pressure of the cleaning liquid that is conveyed through the second outlet coupler 148 and the second inlet 152. The reduction of the pressure of the cleaning liquid prevents the concentrate section of the ratio pump 44 from being damaged due to high pressure cleaning liquids.

In certain examples, the gas infused liquid to concentrate blend ratio is achieved by a fixed piston/cylinder stroke arrangement ratio pump that is hydraulically driven by the gas infused liquid at a selected pressure (e.g. 25 psi). In certain examples, the insulated enclosure 92 cools the ratio pump 44 and the boost pump 40 to assist in keeping the reconstituted beverage above the equilibrium pressure. In certain examples, a shut-off device (not shown) stops dispense of the reconstituted beverage when the amount of gas infused liquid is less than a preselected amount. That is, the shut-off device prevents the ratio pump 44 from operating in such a way that the absence of concentrate prevents dispense. The shut-off device includes a float chamber switch and vacuum switch (with the outlet port closable by the float) such that when the float falls, the shut off valve closes and the beverage is prevented from being dispensed. The present inventors have recognized that the shut-off device, or like device, can be an important feature of the beverage dispenser 10 to ensure that beverages are safely dispensed to consumers. Specifically, the present inventor has recognized that beverages dispensed with a higher amount of alcoholic concentrate than the base fluid may lead to beverages dispensed with high amounts of alcohol. These beverages with high amounts of alcohol could affect the quality (e.g.

taste) of the beverage and cause customers to ingest more alcohol than anticipated with could lead to personal medical complications.

The present inventor has recognized that the foam height of the beverage during dispense is a major problem for gas infused liquids mixed with alcoholic concentrates. By using the boost pump 40, a controlled foam height during dispense can be achieved because the gas infused liquid and/or the reconstituted beverage are maintained at the equilibrium pressure such that the pressure in the reconstituted beverage can be controlled and reduced slowly and smoothly as the reconstituted beverage approaches and/or dispensed from the tap 70. In certain examples, the reconstituted beverage flows through a restrictor tube 74, a capillary tube restrictor, and/or another device, as the beverage approaches and/or conveys through the tap 70.

Furthermore, the gas levels (e.g. carbonation levels) in the reconstituted beverage need to be accurately controlled with the aim of repeatedly dispensing high-quality reconstituted beverages. In conventional mixing/blending systems, gas levels can be difficult to manage when mixing the gas with common sources of the base fluids. Accordingly, in certain examples the beverage dispenser 10 can make use of fixed temperature carbonation (i.e. at 1.0 degree Celsius+/−1.0 degrees Celsius) with low fluid pressures applied to the gas and the base fluid to thereby arrive precise levels or ratios of infusion (e.g. carbonation). Once the gas infused liquid is infused to the desired ratio, no further blending with the base fluid is required and the boost pump 40 is then used to provide the required dispense pressure and/or speed of the reconstituted beverage.

In certain examples, distances between a back room (e.g. back of house storage room) and the tap 70 may be significant. Where blending of the concentrate takes place in the back room, a large amount of the concentrate would be held in the connecting line between the back room and the tap 70. This is seen as a problem for potential wastage due to cleaning and in the event of line contamination from concentrate changeovers. The beverage dispenser 10 allows blending to take place in the back room so that only finished beer product is introduced to the cooled beverage line 90.

In certain examples, the beverage dispenser 10 includes a control board with a remove display board having multiple control board inputs (12V DC power supply, 115V AC from an external supply system, a gas pressure switch, a water level sensor, and a concentrate sensor input facility), multiple control board outputs (LEDs for each concentrate sensor, outputs for various valves and latching valves, RJ45 output to a remote user interface module or indicator), and user interface display or indicator. The control board can include an integrated controller, and the controller can be configured to indicate via an indicator when the input fluids (base fluid, gas, concentrate, electrical power) are interrupted, out-of-stock, or removed from the beverage dispenser. For example, if the gas or base fluid sensors detect low levels the latching valve will immediately close and the associated LEDs will be illuminated. In another example, in the event of a sudden loss of power, the latching valve will be immediately close. In another example, the LEDs will illuminate to indicate that attention is required when the gas, the base fluid, or the concentrate is not sensed or detected. When fluid supplies are being restocked, the latching valve will be set to open and related LEDs will be turned off. A reset function will be provided so that, in the event of sensor activation such as for low gas pressure, the beverage dispenser can be serviced and then restarted.

In certain examples, the insulated enclosure is replaced by a cold water recirculation refrigeration system with an actively cooled clam-shell jacket arrangement to cool the boost pump, the concentrate source, the ratio pump, and/or the mixing chamber. In this cold water recirculation refrigeration system, refrigerated coolant is conveyed in very close proximity to the surfaces of the blending elements (e.g. boost pump, the ratio pump, the mixing chamber) by means of close fitting heat exchanger element such as a molded, cast, fabricated, and/or flexible jacket coupled to the blending components. The heat exchanger or jacket is provided with suitable thermal insulation to maximize the cooling effect upon the blending elements.

In certain examples, the beverage dispenser includes a beverage quality protection system that is configured to stop dispense of the reconstituted beverage when the gas, the base fluid, and/or the concentrate are not being conveyed through the beverage dispenser or at specified pressures. The beverage quality protection system can include a sensor configured to sensor or monitor an extreme low level of the base fluid within the gas infusion device. A second sensor is configured to sense or monitor the availability of gas at a required or preselected pressure. An electric valve is arranged in close proximity to the gas infused liquid and/or the reconstituted beverage to thereby dispense the reconstituted beverage from the tap based on the sensed pressures. In another example, a third sensor is configured to sensor or monitor the availability of concentrate from a non-vented container (e.g. a bag-in-box container) at the point of dispense from the non-vented container and thereby alert an operator via lights or LEDs of the conditions of the gas, base fluid, and/or concentrate.

Figure 7:
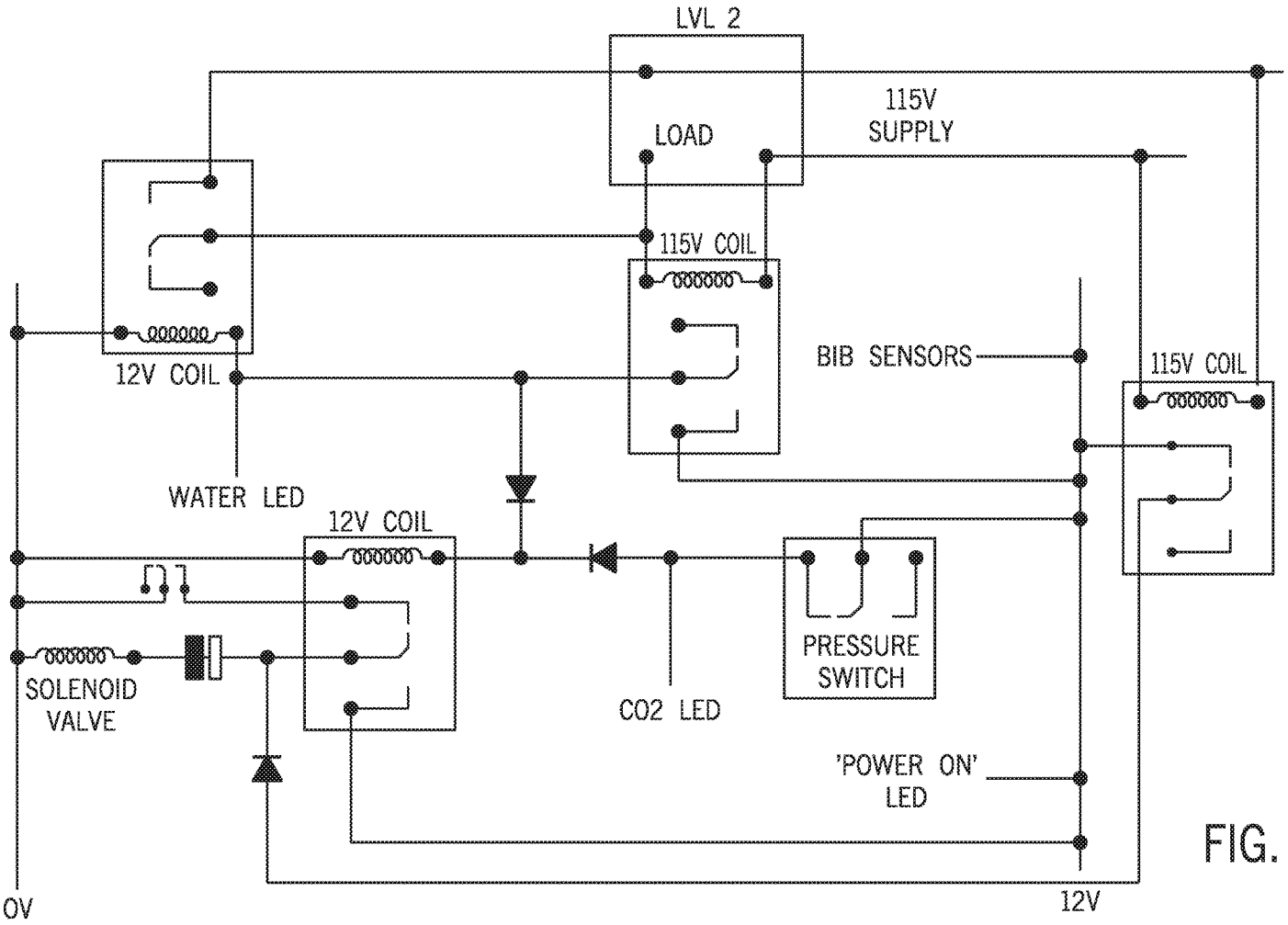
FIG. 7 is an example electrical schematic for the beverage dispenser.

Referring to FIG. 7 an example electrical schematic for the beverage dispenser 10 is depicted. Various sensors, indicators, lights, LEDS, switches and/or other components described therein are electrically connected together and to power supplies (e.g. 12V coil, 115V coil, 115V supply).

Figure 8:
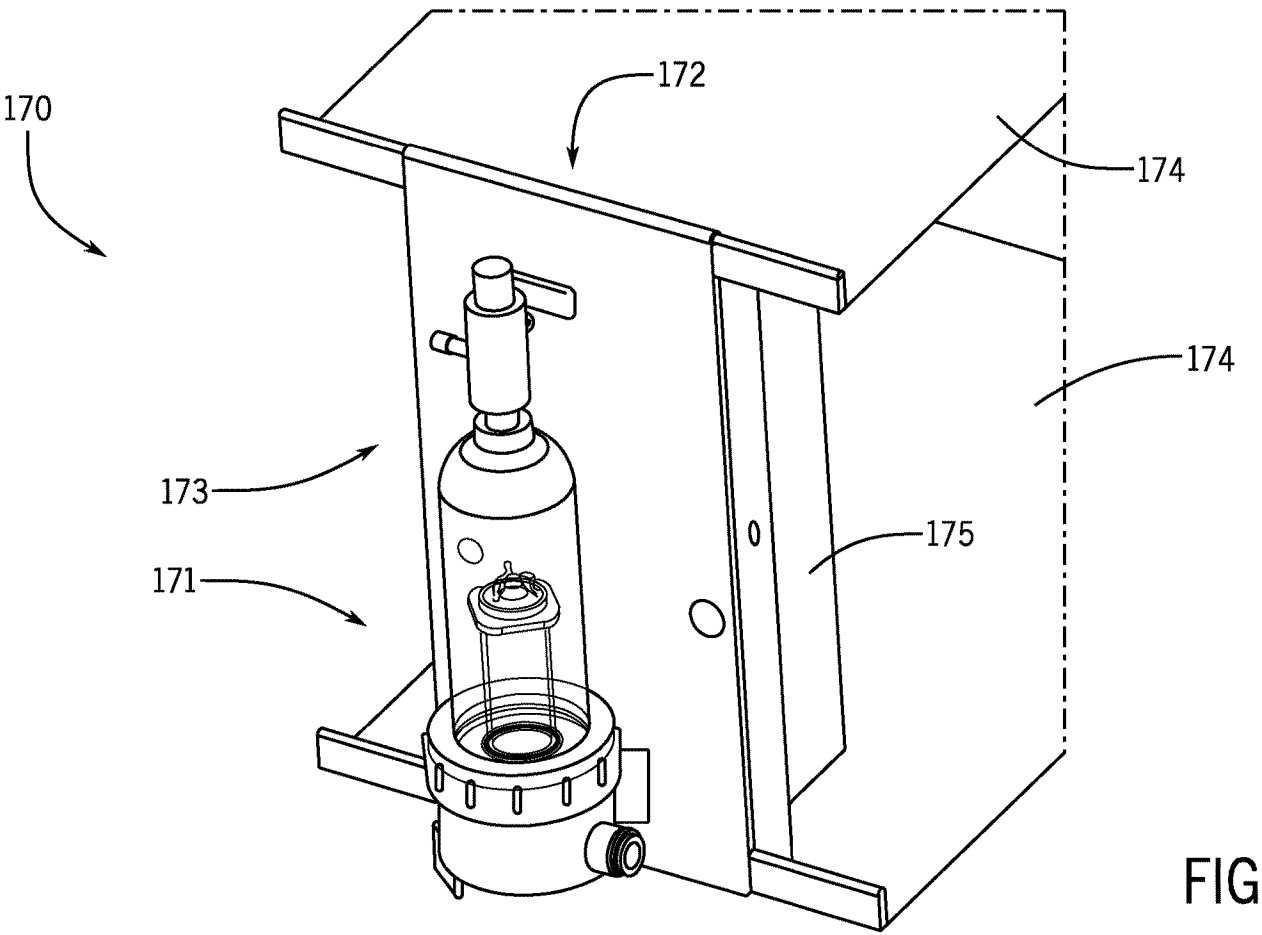
FIG. 8 is an example air-stop system.

The present inventor has recognized that ambient air or other gasses entering the flow of the base liquid, the concentrate, and/or the gas infused liquid can create operational problems for components (e.g. the ratio pump 44) of the beverage dispenser 10 and/or lower the efficiency of the beverage dispenser 10. Accordingly, the present inventor has developed an air-stop system 170 (FIG. 8) that is configured to stop dispense of beverage from the tap 70 before ambient air or other non-desired gases enter the base liquid, the concentrate, and/or the gas infused liquid. The air-stop system 170 is also configured to indicate via an indicator positioned near the tap 70 that air has entered the liquid flows. The air-stop system 160 can operate with air (or no air) is present in the concentrate source (e.g. bag-in-box), and the air-stop system 170 can be easily reset by the operator when any problems are resolved. The air-stop system 170 can include a foam on beer sensor 171 in communication with a controller. Based on the parameter sensed by the sensor 171, the controller can trigger dispense line stop valve(s) to stop flow of the base fluid and the gas. The sensor 171 can include a vacuum sensor and senses when the concentrate source is changed and no air is present in the line. The air-stop system 170 aims to protect the beverage dispenser from air or extracted gases from the concentrate during concentrate source replacement (e.g. both flows of liquid are stopped until the concentrate source is replaced) and prevent unmanageable foam problems. The air-stop system 170 can include a hook-on module 172 which may couple to the beverage dispenser 10 and/or a separate object (e.g. a shelf). The operator can release air from the air-stop system 170 by turning a lever valve. The air-stop system 170 can be part of a module 173 that includes wheel-out trolley shelves 174 and a switch enclosure 175 with retaining features.

In certain examples, a beverage dispenser includes a gas infusion device that receives a base fluid and a gas and dispenses a gas infused liquid comprising the base fluid and the gas. A ratio pump receives the gas infused liquid and a concentrate from a concentrate source and dispenses a predetermined ratio of the gas infused liquid and the concentrate. A mixing chamber mixes the predetermined ratio of the gas infused liquid and the concentrate to form a reconstituted beverage. A valve receives the reconstituted beverage and dispenses the reconstituted beverage to the operator. An insulated enclosure has an interior space in which the ratio pump and the mixing chamber are positioned. A cooling coil is positioned in the insulated enclosure, and a first refrigeration system circulates a cooling media through the cooling coil to thereby cool the interior space to a predetermined temperature such that the gas infused liquid and the concentrate dispensed from the ratio pump and the mixing chamber are cooled to the predetermined temperature. The concentrate source is positioned in the interior space such that the concentrate source and concentrate therein are cooled to the predetermined temperature. In certain examples, the predetermined temperature is 6.0 degrees Celsius In certain examples, a boost pump can be configured to increase the pressure of the gas infused liquid such that the gas is maintained in the gas infused liquid during operation of the beverage dispenser. The boost pump is positioned in the interior space such that the gas infused liquid is cooled to the predetermined temperature. A heat exchanger can be positioned in the interior space and coupled to the cooling media coil such that heat is transferred from air in the interior space to the heat exchanger and the cooling media coil. A fan positioned in the interior space and configured to move the air in the interior space across the heat exchanger. In certain examples, a cooling tank configured to receive a cooling media and a second refrigeration system configured to cool the cooling media and a pump is coupled to the cooling media coil to thereby convey cooling media through the cooling media coil. In certain examples, a beverage cooling coil is positioned in the cooling tank such that the cooling media contacts the beverage cooling coil, and the reconstituted beverage is conveyed through the beverage cooling coil such that the reconstituted beverage is cooled by the cooling media. The gas infusion device is positioned in the cooling tank such that the cooling media contacts the gas infusion device and the gas infused liquid dispensed by the gas infusion device is cooled.

In certain examples, an auto-vent assembly vents gas from the gas infusion device when pressure of the gas in the gas infusion device is greater than a predetermined maximum pressure. The auto-vent assembly has a sensor configured to sense pressure of the gas in the gas infusion device and a valve configured to open when the pressure sensed by the sensor is greater than the predetermined maximum pressure. The auto-vent assembly has an outlet control throttle configured to control the flow of the gas vented form the gas infusion device and a check valve configured to prevent the gas from back-flowing into a gas source. A controller is in communication with the sensor and configured to open the valve based on the pressure sensed by the sensor. The controller has a memory that stores the predetermined maximum pressure, and the controller is configured to compare the pressure sensed by the sensor to the predetermined maximum pressure In certain examples, a beverage dispenser has a gas infusion device receives a gas and a base liquid and dispenses a gas infused liquid comprising the gas and the base liquid. A ratio pump receives the gas infused liquid and a concentrate and dispenses a predetermined ratio of the concentrate and the gas infused liquid. The predetermined ratio of the concentrate and the gas infused liquid form a reconstituted beverage. A valve receives the reconstituted beverage and dispenses the reconstituted beverage to the operator. A boost pump increases the pressure of the gas infused liquid such that the gas is maintained in the gas infused liquid during operation of the beverage dispenser, and the boost pump maintains pressure of the gas infused liquid at or above an equilibrium pressure such that pressure of the reconstituted beverage upstream from the valve is equal to or greater than the equilibrium pressure when the valve is opened. In certain examples, the gas infusion device is a carbonator. The boost pump can be further configured to increase the pressure of the gas infused liquid to a hyper-equilibrium pressure when the valve is closed such that when the valve is opened the liquid pressures of the gas infused liquid and the reconstituted beverage are equal to or greater than the equilibrium pressure. The equilibrium pressure can be between 25.0 psi and 32.0 psi and the hyper-equilibrium pressure can be between 55.0 and 65.0 psi. In certain examples, the equilibrium pressure is 31.0 psi and the hyper-equilibrium pressure is 62.0 psi In certain examples, a mixing chamber positioned downstream of the ratio pump to thereby receive and mix the predetermined ratio of the gas infused liquid and the concentrate to form the reconstituted beverage. The mixing chamber has an upstream inlet configured to receive the predetermined ratio of the gas infused liquid and the concentrate, a cavity configured to mix the predetermined ratio of the gas infused liquid and the concentrate to form the reconstituted beverage, and a downstream outlet configured to dispense the reconstituted beverage. The upstream inlet and the downstream outlet are positioned vertically above the cavity. The boost pump, the ratio pump, and the mixing chamber are positioned in an insulated enclosure defining an interior space, and a refrigeration system cools the interior space to a suitable temperature such that temperatures of the liquids dispensed from the boost pump, the ratio pump, and the mixing chamber are cooled to the predetermined temperature. In certain examples, the suitable temperature is 6.0 degrees Celsius.

In certain examples, a restrictor device is positioned downstream of the mixing chamber and upstream of the valve. The restrictor tubing configured to control flow of the reconstituted beverage from the valve and restrict the flow of the reconstituted beverage from the valve such that the gas breaks-out from the reconstituted downstream of the valve. In certain examples, a sensor is configured to sense pressure of the reconstituted beverage downstream of the mixing chamber and upstream of the valve, and a controller is in communication with the sensor and the boost pump, the controller configured to control the boost pump based on the pressure sensed by the sensor.

In certain examples, a gas sensor is configured to absence of the gas, a base fluid sensor is configured to sense absence of base fluid, and a concentrate sensor is configured to sense absence of the concentrate. A latching valve is configured to close and thereby prevent flow of the gas infused liquid to the ratio pump, and the controller is in communication with the gas sensor, the base fluid sensor, the concentrate sensor, and the latching valve, and the controller is configured to close the latching valve when the gas sensor, the base fluid sensor, or the concentrate sensor senses absence of the gas, the base fluid, or the concentrate. An indicator can be configured to indicate closure of the latching valve based on the position of the latching valve, and the controller is configured to control the indicator to indicate closure of the latching valve.

In certain examples, a line cleaning apparatus for use with a beverage dispenser has a first inlet and a second inlet includes an inlet coupler configured to receive a cleaning liquid from a cleaning liquid source; a first outlet coupler in fluid communication with the inlet coupler and being configured to couple to the beverage dispenser such that the cleaning liquid is dispensed to the first inlet to thereby clean the beverage dispenser downstream of the first inlet; and a second outlet coupler in fluid communication with the inlet coupler and being configured to couple to the beverage dispenser such that the cleaning liquid is dispensed to the second inlet to thereby cleans the beverage dispenser downstream of the second inlet. The cleaning liquid is pressurized, and a regulator is configured to reduce pressure of the cleaning liquid dispensed by the second outlet coupler to the second inlet.

In certain examples, a beverage dispenser has a gas infusion device configured to receive a base fluid and a gas and dispense a gas infused liquid comprising the base fluid and the gas; a ratio pump configured to receive the gas infused liquid and a concentrate from a concentrate source and dispense a predetermined ratio of the gas infused liquid and the concentrate; and a mixing chamber configured to mix the predetermined ratio of the gas infused liquid and the concentrate to form a reconstituted beverage. A valve receives the reconstituted beverage and dispenses the reconstituted beverage to the operator. The beverage dispenser has a first inlet, a second inlet, and a line cleaning apparatus. The line cleaning apparatus has an inlet coupler configured to receive a cleaning liquid from a cleaning liquid source, a first outlet coupler in fluid communication with the inlet coupler such that the cleaning liquid is dispensed to the first inlet to thereby clean the beverage dispenser downstream of the first inlet; and a second outlet coupler in fluid communication with the inlet coupler such that the cleaning liquid is dispensed to the second inlet to thereby cleans the beverage dispenser downstream of the second inlet.

A method of reconstituting an alcoholic beverage includes receiving, with a gas infusion device, base fluid and a gas to be infused into the base fluid to thereby form a gas infused liquid; increasing, with a boost pump, pressure of the gas infused liquid; receiving, with a ratio pump, the gas infused liquid and a concentrate; dispensing, with the ratio pump, a predetermined ratio of the gas infused liquid and concentrate; mixing, with a mixing chamber, the predetermined ratio of the gas infused liquid and the concentrate to form a reconstituted beverage; and dispensing, with a valve, the reconstituted beverage to an operator. The method can also include the steps of cooling, with a refrigeration system, the gas infused liquid and the concentrate dispensed from the ratio pump and the mixing chamber to a predetermined temperature.

This written description uses examples to disclose the invention, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A beverage dispenser comprising:

a gas infusion device configured to receive a base fluid and a gas and dispense a gas infused liquid comprising the base fluid and the gas;

a mixing chamber configured to receive a predetermined amount of the gas infused liquid from the gas infusion device and a predetermined amount of a concentrate from a concentrate source and mix the gas infused liquid and concentrate to form a reconstituted beverage;

a valve configured to receive the reconstituted beverage and dispense the reconstituted beverage;

an insulated enclosure that defines an interior space in which the mixing chamber is positioned;

a cooling coil positioned in the insulated enclosure; and a first refrigeration system configured to circulate a cooling media through the cooling coil to thereby cool the interior space to a predetermined temperature such that the gas infused liquid and the concentrate received in the mixing chamber are cooled to the predetermined temperature.

2. The beverage dispenser according to claim 1, wherein the predetermined temperature is 6.0 degrees Celsius.

3. The beverage dispenser according to claim 2, further comprising a boost pump configured to increase the pressure of the gas infused liquid such that the gas is maintained in the gas infused liquid during operation of the beverage dispenser, and wherein the boost pump is positioned in the interior space such that the gas infused liquid is cooled to the predetermined temperature.

4. The beverage dispenser according to claim 3, further comprising a heat exchanger positioned in the interior space and coupled to the cooling coil such that heat is transferred from air in the interior space to the heat exchanger and the cooling coil.

5. The beverage dispenser according to claim 4, further comprising a fan positioned in the interior space and configured to move the air in the interior space across the heat exchanger.

6. The beverage dispenser according to claim 4, further comprising:

a cooling tank configured to receive a cooling media and a second refrigeration system configured to cool the cooling media; and a pump coupled to the cooling media coil configured to thereby convey cooling media through the cooling coil.

7. The beverage dispenser according to claim 6, further comprising a cooled beverage line through which the reconstituted beverage is conveyed, and wherein the pump is further configured to convey cooling media through the cooled beverage line to thereby cool the reconstituted beverage.

8. The beverage dispenser according to claim 7, further comprising a beverage cooling coil positioned in the cooling tank such that the cooling media contacts the beverage cooling coil, and wherein the reconstituted beverage is conveyed through the beverage cooling coil such that the reconstituted beverage is cooled by the cooling media.

9. The beverage dispenser according to claim 7, wherein the gas infusion device is positioned in the cooling tank such that the cooling media contacts the gas infusion device and the gas infused liquid dispensed by the gas infusion device is cooled.

10. The beverage dispenser accordingly to claim 1, further comprising:

an auto-vent assembly configured to vent gas from the gas infusion device when pressure of the gas in the gas infusion device is greater than a predetermined maximum pressure, the auto-vent assembly having:

a sensor configured to sense pressure of the gas in the gas infusion device; and a valve configured to open when the pressure sensed by the sensor is greater than the predetermined maximum pressure.

11. The beverage dispenser according to claim 10, wherein the auto-vent assembly has an outlet control throttle configured to control the flow of the gas vented from the gas infusion device.

12. The beverage dispenser according to claim 10, wherein the gas infusion device receives the gas from a gas source, and wherein the auto-vent assembly has a check valve configured to prevent the gas from back-flowing into the gas source.

13. The beverage dispenser according to claim 10, wherein the auto-vent assembly has a controller in communication with the sensor and configured to open the valve based on the pressure sensed by the sensor.

14. The beverage dispenser according to claim 13, wherein the controller has a memory that stores the predetermined maximum pressure, and wherein the controller is configured to compare the pressure sensed by the sensor to the predetermined maximum pressure.

15. A beverage dispenser comprising:

a gas infusion device configured to receive a gas and a base fluid and dispense a gas infused liquid comprising the gas and the base fluid;

a mixing chamber configured to receive the gas infused liquid and a concentrate, mix the gas infused liquid and the concentrate to form a reconstituted beverage, and dispense the reconstituted beverage;

a valve configured to receive the reconstituted beverage and selectively open to thereby dispense the reconstituted beverage; and a boost pump configured to increase the pressure of the gas infused liquid such that the gas is maintained in the gas infused liquid during operation of the beverage dispenser;

wherein the boost pump is further configured to maintain pressure of the gas infused liquid at or above an equilibrium pressure such that pressure of the reconstituted beverage upstream from the valve is equal to or greater than the equilibrium pressure when the valve is opened.

16. The beverage dispenser according to claim 15, wherein the gas infusion device is a carbonator.

17. The beverage dispenser according to claim 16, wherein the boost pump is further configured to increase the pressure of the gas infused liquid to a hyper-equilibrium pressure when the valve is closed such that when the valve is opened the liquid pressures of the gas infused liquid and the reconstituted beverage are equal to or greater than the equilibrium pressure.

18. The beverage dispenser according to claim 17, wherein the equilibrium pressure is between 25.0 psi and 32.0 psi, and wherein the hyper-equilibrium pressure is between 55.0 psi and 65.0 psi.

19. The beverage dispenser according to claim 18, wherein the equilibrium pressure is 31.0 psi, and wherein the hyper-equilibrium pressure is 62.0 psi.

20. The beverage dispenser according to claim 17, wherein the mixing chamber has an upstream inlet configured to receive the gas infused liquid and the concentrate, a cavity configured to mix the gas infused liquid and the concentrate to form the reconstituted beverage, and a downstream outlet configured to dispense the reconstituted beverage, wherein the upstream inlet and the downstream outlet are positioned vertically above the cavity.

21. The beverage dispenser according to claim 17, further comprising:

an insulated enclosure defining an interior space in which the boost pump and the mixing chamber are positioned; and a refrigeration system configured to cool the interior space to a predetermined temperature such that temperatures of the liquids dispensed from the boost pump and the mixing chamber are cooled to the predetermined temperature.

22. The beverage dispenser according to claim 21, wherein the predetermined temperature is 6.0 degrees Celsius.

23. The beverage dispenser according to claim 17, further comprising a restrictor device positioned downstream of the mixing chamber and upstream of the valve, the restrictor device configured to control flow of the reconstituted beverage from the valve and restrict the flow of the reconstituted beverage from the valve such that the gas breaks-out from the reconstituted downstream of the valve.

24. The beverage dispenser according to claim 17, further comprising:

a sensor configured to sense pressure of the reconstituted beverage downstream of the mixing chamber and upstream of the valve; and a controller in communication with the sensor and the boost pump, the controller configured to control the boost pump based on the pressure sensed by the sensor.

25. The beverage dispenser according to claim 24, further comprising:

a gas sensor configured to sense absence of the gas;

a base fluid sensor configured to sense absence of the base fluid;

a concentrate sensor configured to sense absence of the concentrate; and a latching valve configured to close and thereby prevent flow of the gas infused liquid to the mixing chamber;

wherein the controller is in communication with the gas sensor, the base fluid sensor, the concentrate sensor, and the latching valve, and wherein the controller is configured to close the latching valve when the gas sensor, the base fluid sensor, or the concentrate sensor senses absence of the gas, the base fluid, or the concentrate.

26. The beverage dispenser according claim 25, further comprising an indicator configured to indicate closure of the latching valve based on the position of the latching valve, and wherein the controller is configured to control the indicator to indicate closure of the latching valve.

27. A beverage dispenser comprising:

a gas infusion device configured to receive a base fluid and a gas and dispense a gas infused liquid comprising the base fluid and the gas;

a mixing chamber configured to receive a predetermined amount of the gas infused liquid from the gas infusion device and a predetermined amount of a concentrate from a concentrate source and mix the gas infused liquid and concentrate to form a reconstituted beverage;

a valve configured to receive the reconstituted beverage and dispense the reconstituted beverage;

a first inlet;

a second inlet; and a line cleaning apparatus having:

an inlet coupler configured to receive a cleaning liquid from a cleaning liquid source;

a first outlet coupler in fluid communication with the inlet coupler such that the cleaning liquid is dispensed to the first inlet to thereby clean the beverage dispenser downstream of the first inlet; and a second outlet coupler in fluid communication with the inlet coupler such that the cleaning liquid is dispensed to the second inlet to thereby cleans the beverage dispenser downstream of the second inlet.

28. The beverage dispenser according to claim 27, wherein the cleaning liquid is pressurized, and further comprising a regulator configured to reduce pressure of the cleaning liquid dispensed by the second outlet coupler to the second inlet.

29. A method of reconstituting an alcoholic beverage, the method comprising:

receiving, with a gas infusion device, a base fluid and a gas to be infused into the base fluid to thereby form a gas infused liquid;

increasing, with a boost pump, pressure of the gas infused liquid;

receiving and mixing, with a mixing chamber the gas infused liquid and a concentrate to form a reconstituted beverage; and dispensing, with a valve, the reconstituted beverage.

30. The method according to claim 29, further comprising:

cooling, with a refrigeration system, the gas infused liquid, the concentrate, and the mixing chamber to a predetermined temperature.

31. The method according to claim 30, wherein the refrigeration system has an insulated enclosure that defines an interior space and a cooling coil positioned in the interior space; and wherein the refrigeration system is configured to circulate cooling media through the cooling coil to thereby cool the interior space to the predetermined temperature.

32. The method according to claim 31, wherein the mixing chamber is positioned in the interior space.

33. The method according to claim 29, wherein the boost pump is further configured to increase the pressure of the gas infused liquid such that the gas is maintained in the gas infused liquid; and wherein the boost pump is further configured to maintain pressure of the gas infused liquid at or above an equilibrium pressure such that pressure of the reconstituted beverage upstream from the valve is equal to or greater than the equilibrium pressure when the valve is opened.

* * * * *